United States Patent [19]

Showalter

[11] Patent Number: 5,040,605

[45] Date of Patent: Aug. 20, 1991

[54] OIL RECOVERY METHOD AND APPARATUS

[75] Inventor: William E. Showalter, Long Beach, Calif.

[73] Assignee: Union Oil Company of California, Los Angeles, Calif.

[21] Appl. No.: 546,518

[22] Filed: Jun. 29, 1990

[51] Int. Cl.[5] ..... E21B 36/00; E21B 43/24

[52] U.S. Cl. ..... 166/302; 166/57; 166/61; 166/62

[58] Field of Search ..... 166/57, 61, 62, 302, 166/303

[56] References Cited

U.S. PATENT DOCUMENTS

| | | | |
|---|---|---|---|
| 760,304 | 5/1904 | Butler | 166/61 |
| 1,012,777 | 12/1911 | Wigle | 166/61 |
| 2,388,640 | 11/1945 | Moore | 166/230 |
| 2,911,047 | 11/1959 | Henderson | 166/61 |
| 2,998,069 | 8/1961 | Stephens | 166/61 |
| 3,343,605 | 9/1967 | Phelan | 166/61 |
| 3,498,381 | 3/1970 | Earlougher, Jr. | 166/303 |
| 3,880,236 | 4/1975 | Durning et al. | 166/302 |
| 3,908,763 | 9/1975 | Chapman | 166/302 |

*Primary Examiner*—Hoang C. Dang

*Attorney, Agent, or Firm*—Gregory F. Wirzbicki; Clark E. De Larvin

[57] ABSTRACT

A method and apparatus are provided for the recovery of a heavy oil, contained in an outcropping formation, without any significant adverse environmental impact. Broadly, the invention comprises indirectly heating an oil containing formation to reduce the viscosity of the oil therein and concurrently thermally insulating an upper portion of the well, extending into the formation, to eliminate any increased seepage of oil from the formation to the surface.

22 Claims, 1 Drawing Sheet

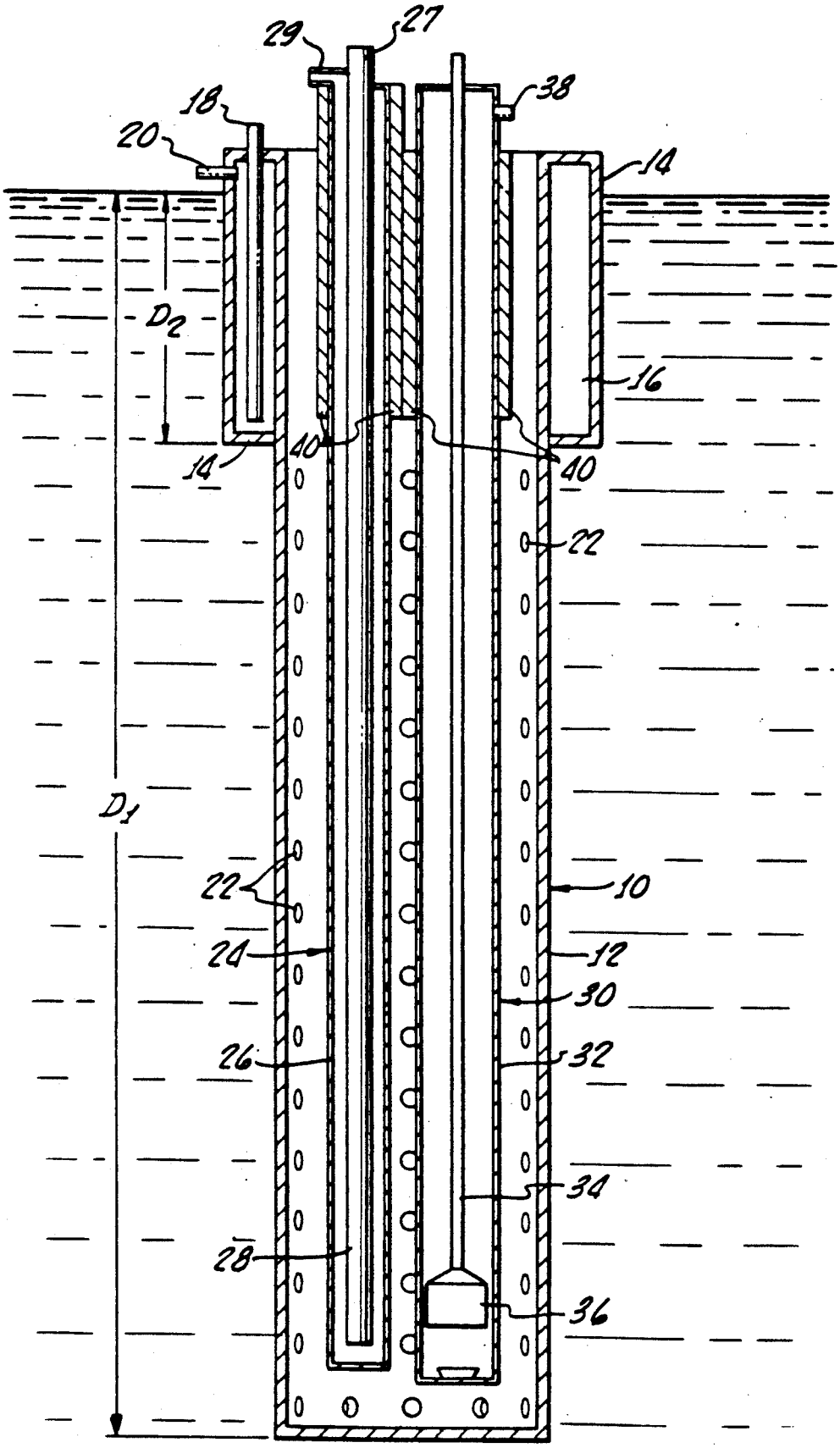
29
27
38
18
20
14
D2
16
40
40
14
22
D1
22
10
24
12
30
26
32
34
28
36

OIL RECOVERY METHOD AND APPARATUS

FIELD OF THE INVENTION

The present invention relates to the recovery of oil from a heavy oil-bearing formation. More particularly, it relates to the recovery of oil from an outcropping, heavy oil-containing, formation.

BACKGROUND OF THE INVENTION

In the production of oil from an oil-bearing formation, numerous problems may be encountered. If the formation is of a loosely consolidated nature, the produced fluids can be expected to contain some particulate matter. It is, of course, undesirable to produce such particulate matter with the production fluids because of abrasion of the production tubing, valves, and other equipment used. In such instances, it is necessary to avoid production of such sand and other particulate matter with the fluids. In other instances, the formation may have a low permeability which will result in low production levels. In such instances, it is necessary to take measures to increase the flow of fluid from the formation.

The physical properties of the oil also will vary substantially. For example, some oils have a relatively low viscosity (light oils) and flow freely into the well casing for recovery. Typical of such oils are those found in the Middle East and Eastern United States. In some areas, the oil is more viscous and generally is referred to as a heavy oil. Typically, oils produced in Alaska and California are heavy oils. When a formation is encountered containing a heavy oil, which is too viscous to flow freely into the casing for recovery, it is necessary to either accept a low production rate or take measures to enhance the recovery rate. A typical enhancement measure comprises heating the oil in the formation to reduce its viscosity. The most common heating method utilizes the direct injection of steam into the formation. Typically, one of two methods is utilized. In one method, steam is injected into the formation through one or more injection wells which are located peripherally about a production well. In the other method, steam is injected directly into a production well for a fixed period of time to heat the formation, after which production from the well is resumed.

In addition to subterranean formations, there also are outcropping, oil-bearing formations in which a portion of the formation is close to the surface and which may have a significant portion exposed to the atmosphere at the surface. Over the millenniums, substantially all of the lower boiling point (light ends) constituents of the oil have evaporated. Such oil is essentially non-pumpable having a semi-solid or tar-like consistency. Substantially little effort has been made to recover oil from these formations because of environmental concerns. More particularly, it has been feared that any attempt to recover oil from these formations could cause increased, uncontrolled oil seepage to the surface at surrounding areas with unintended environmental damage. Clearly, it would be beneficial if there was a way to recover oil from such formations, provided such recovery could be accomplished without adversely affecting the environment.

SUMMARY OF THE INVENTION

The present invention provides an oil recovery method and apparatus which are uniquely applicable to a heavy oil-containing, outcropping formation. It is an advantage of the present invention that it provides for the recovery of oil from such a formation without risk of causing increased oil seepage from the surface outcrop.

In accordance with the method of the present invention, a casing is placed in a heavy oil-containing formation a distance of at least about 1000 feet. The casing comprises a lower portion provided with a plurality of apertures for the passage of oil therethrough and an upper portion surrounded by a cooling jacket. The cooling jacket extends axially along the length of the upper portion of the casing a distance of at least about 75 feet. A heated fluid is circulated substantially throughout the length of the interior of the casing in indirect, heat-exchange relationship therewith. The casing and adjacent portions of the formation are heated to a temperature at which the oil will flow through the apertures into the casing. Near the surface, a coolant is circulated through the coolant jacket in indirect heat exchange with the casing. The coolant is circulated at a rate sufficient to prevent transfer of heat from the upper portion of the casing into the adjacent formation. The heated oil is recovered from the formation adjacent the lower portion of the casing without any significant physical effect on the remaining portions of the formation.

The apparatus for recovery of oil from the heavy oil-containing, outcropping formation comprises an elongated casing, having an upper portion circumferentially surrounded by a cooling jacket, and a lower portion, provided with a plurality of apertures about its length and circumference, for the passage therethrough of oil. The apparatus further comprises an indirect heat exchanger located within the casing and extending substantially throughout its length. A pump is located within the casing for pumping oil from a lower portion of the casing to the upper portion. Means are provided for the circulation of coolant through the cooling jacket and a heated fluid through the indirect heat exchanger.

DETAILED DESCRIPTION OF THE PREFERRED EMBODIMENT

The present invention is applicable to any heavy (viscous) fluid-bearing formation. For convenience, it will be described with respect to a heavy oil-containing, outcropping formation. The invention will be illustrated by a detailed description of a preferred embodiment thereof. It will be understood by those skilled in the art that variations and modifications of this preferred embodiment may be effected without departing from the scope of the invention.

As used herein the term "heavy oil" is defined as those oils having an API gravity of less than 15°. Frequently the heavy oil will have an API gravity of less than 10°. There are many heavy oil-containing formations to which the present invention would be applicable. For example, in the eastern Brea Canyon, Tonner and Olinda areas of Southern California, there are several such formations which are only a short distance below the surface and many of which are outcropping. As used herein the term "outcropping formation" refers to a fluid bearing formation which has a significant portion less than about 50 feet below the ground surface, as well as those which have an exposed surface. These formations range in thickness from 50 to as much as several hundred feet or more and extend downwardly and laterally from 1000 to 5000 feet or more.

Referring now to FIG. 1, therein is depicted in apparatus 10 for use in the practice of the present invention. Apparatus 10 comprises an elongated casing 12. Typically, casing 12 will have a length $D_1$ of at least about 1000 feet up to about 5000 feet or more. Preferably, casing 12 has a length in the range of from about 2000 to 4000 feet.

An upper end of casing 12 is surrounded by a cooling jacket 14. Cooling jacket 14 encompasses an outer periphery of casing 12 forming an annular space 16 for receiving a flow of coolant therethrough. Cooling jacket 14 extends linearly along the length of casing 12 a distance $D_2$ of at least 75 feet, preferably in excess of 150 feet and even more preferably in excess of about 200 feet, for reasons which will be described later. Cooling jacket 14 also is provided with a coolant inlet 18 and a coolant outlet 20.

The lower portion of casing 12, which extends below cooling jacket 14, is provided with a plurality of apertures or perforations 22. Perforations 22 may have any cross sectional shape; for example, they may be ellipsis, circles, slots or irregular. It is essential, however, that they extend substantially throughout the length and about the circumference of the lower portion of casing 12 and are sufficiently large to permit the flow of oil therethrough.

Located within casing 12 is an indirect heat exchanger assembly 24, which also extends substantially throughout the length of casing 12. As depicted heat exchanger assembly 24 comprises an outer tubular member 26 (closed at its lower end) and an inner, coaxial, tubular member 28. Heat exchanger assembly 24 includes an inlet 27 and outlet 29 for the introduction and withdrawal, respectively, of a heat exchange medium. Tubular members 26 and 28 cooperatively form a fluid flow path between inlet 27 and outlet 29.

Also located within casing 12 and extending into a lower portion thereof, is a pump assembly 30. Typically, pump assembly 30 is a sucker-rod pump assembly of the type generally used in the petroleum industry. Such pumps comprise an outer housing 32, a sucker rod 34, and a sucker-rod pump piston 36. An upper end of pump assembly 30 is provided with a discharge port 38.

In accordance with a particularly preferred embodiment, the lower portion of casing 12 is encompassed with a filter means to prevent the entry of sand and any other particulates from the formation. More particularly, the outer circumference of the casing preferably is wrapped with a screen having openings sized to permit the passage of oil therethrough, but sufficiently small to prevent the passage therethrough of any significant quantities of particulate material from the producing formation. The preferred filter means comprises a wire-wrapped casing, as is known in the industry for such function.

Advantageously, the upper portion of heat exchanger assembly 24 and pump assembly 30 are each provided with thermal insulators 40. Ideally, insulators 40 will comprise insulated tubing which extends axially along heat exchanger 24 and pump assembly 30 for distance substantially equal to that of cooling jacket 14. Insulated tubing of the type used for conventional steam injection are utilizable with the present invention. Obviously, other insulating means also may be utilized.

In accordance with the method of the present invention, a bore hole is first drilled into a heavy oil-containing, outcropping formation. The bore hole may be initiated at a point where the outcropping occurs or in an adjacent area where the oil-bearing formation is in relatively close proximity to the surface. For example, the formation should be at a depth of less than about 50 feet and preferably a depth of less than 20 feet. The bore hole is drilled into the formation to a depth of at least 1000 feet and preferably a depth of from 2000 to 4000 feet. It will be appreciated this need not be a vertical bore hole; thus, offset and directional drilling techniques may be utilized to extend the bore hole the desired length into the producing formation.

After completion of the bore hole, and a larger bore to accommodate the cooling jacket, an apparatus substantially as described with reference to FIG. 1 is assembled and introduced into the bore hole. Generally, the casing will be inserted in multiple sections. Coolant, typically water, is circulated through annular space 16 of cooling jacket 14. The rate of flow of coolant is regulated to ensure that no substantial amount of heat is transmitted from casing 12 to the adjacent oil-bearing formation near the surface.

A heating fluid, typically steam, is circulated through indirect heat exchanger assembly 26. The flow of steam through heat exchanger assembly 24 is continued until sufficient heat is radiated into the formation to heat the oil to a temperature at which it flows into casing 12. Thereafter, pump assembly 30 is placed in operation to recover the heated oil from the interior of casing 12.

It will be appreciated that indirect heating of a subterranean formations has not been considered practical heretofore. Heat transfer rates from a hot well bore casing into the formation around the well are low. In addition, the temperature gradient from the hot well bore into the formation around the well drop sharply. For these two reasons, indirect heating has not, heretofore, been considered practical.

For example, assume there is a 50 foot thick producing formation at a depth of 1000 feet and the formation has a 40 percent porosity and a 70 percent oil saturation (2200 barrels/acre-foot). Further, assume that, after about 110 days of heating, the heat front is 18 feet from the well and the temperature profile from the well bore out to a distance of 18 feet declines from approximately 180° F. to about 60° F. Under such conditions there will be 1.2 acre feet of formation behind the heat front, however, only 0.23 acre-feet (506 barrels of oil) will be heated to a temperature which will produce an oil having sufficient mobility to flow into the casing.

The present invention over comes such disadvantages. The present invention provides for the economic recovery of heavy oils from formations containing the same. It also substantially eliminates the potential danger of increasing oil seepage to the surface from such oil bearing formations.

In accordance with the present invention, a 1000 foot well extending through a producing formation (even with the top 200 feet thermally isolated) will extend through 800 feet of productive formation. That will leave 19 acre-feet of formation behind the heat front and 3.7 acre-feet (8000 barrels of oil) will be heated sufficiently to produce oil having the desired mobility. The heat requirement to accomplish this is calculated to be about 340,000 BTU's per hour. For comparison, cyclic steam injection frequently utilizes injection rates which provide heat inputs 20 to 40 times greater than that of the present invention.

By insulating the upper portion of the casing, no heat is transferred near the surface where it might cause localized surface seepage of oil and environmental harm. Similarly, the localized heating along the lower portion of casing 12 ensures that the heated oil flows into the casing for recovery. Thus, the present invention provides an apparatus and method for recovery of oil from formations heretofore considered either economically impractical or environmentally unsafe.

While the invention has been described in the more limited aspect of the preferred embodiment thereof, other embodiments have been suggested and still others will occur to those skilled in the art. For example, while the invention has been described utilizing two concentric tubes for the indirect heat exchanger, a coiled tubing extending about the periphery of the sucker rod pump also could be utilized. In addition, a different type of pump could be utilized, for example, a down hole motor-driven pump. It is intended that all such variations and embodiments be included within the scope of the invention as defined by the appended claims.

What is claimed is:

1. An apparatus for the recovery of oil from an outcropping oil-containing formation having a significant portion less than 50 feet below the earth's surface, said apparatus comprising:

an elongated housing having an upper and a lower portion, extending a length of at least 1000 feet into said formation, and said lower portion having apertures about its periphery and substantially throughout its length;

a cooling jacket encompassing the upper portion of the housing and extending axially downward along the length of the housing a distance of at least 75 feet;

an indirect heat-exchanger located within said housing and extending substantially throughout its length;

a pump located within the housing for pumping fluids from the lower portion of said housing to the upper portion; and means for circulating a coolant through said jacket and a heated fluid through said indirect heat exchanger.

2. The apparatus of claim 1 wherein said pump is a sucker-rod pump.

3. The apparatus of claim 1 wherein said indirect heat exchanger comprises two coaxial concentric tubes, one of said tubes having an inlet for a heated fluid and the other of said tubes having an outlet for said fluid, both of said tubes extending substantially throughout the length of said housing, the outermost of said tubes being closed at its bottom end and said tubes cooperatively defining a fluid flow path between said inlet and outlet.

4. The apparatus of claim 1 wherein the lower portion of said housing is enclosed in a wire mesh.

5. The apparatus of claim 1 further comprising means for filtering particulates, said means being disposed about an outer periphery of the lower portion of said housing.

6. The apparatus of claim 1 further comprising insulating means encompassing the periphery of said heat exchanger substantially throughout the length of the upper portion of said housing.

7. The apparatus of claim 1 wherein said housing has a length of from 1000 to 5000 feet.

8. The apparatus of claim 7 wherein said cooling jacket extends a distance of at least 150 feet.

9. The apparatus of claim 8 wherein said pump is a sucker rod pump.

10. The apparatus of claim 9 wherein said indirect heat-exchanger comprises two coaxial concentric tubes of one of said tubes having an inlet for a heated fluid and the other of said tubes having an outlet for said fluid, both of said tubes extending substantially throughout the length of said housing, the outer most of said tubes being closed at its bottom end and said tubes cooperatively defining a fluid flow path between said inlet and outlet.

11. The apparatus of claim 10 further comprising means for filtering particulates, said means being disposed about an outer periphery of the lower portion of said housing.

12. The apparatus of claim 11 further comprising insulating means and encompassing the periphery of said heat exchanger substantially throughout the length of the upper portion of said housing.

13. A method for recovering oil from an oil-containing, outcropping formation having a significant portion less than 50 feet below the earth's surface, comprising:

introducing a casing into said formation said casing extending a distance of at least about 1000 feet into said formation, said casing comprising an upper portion terminating at its upper end adjacent a well head and a lower portion having a plurality of apertures for the passage therethrough of oil;

heating the casing and adjacent formation to a temperature at which oil flows into said casing by circulating a heated fluid substantially throughout the length of said casing and in indirect heat-exchange with the casing, circulating a coolant in indirect heat exchange about the upper portion of the casing, said coolant being circulated at a rate sufficient to substantially prevent transfer of heat from the upper portion of the casing to the adjacent formation; and recovering oil from said casing.

14. The method of claim 13 wherein said coolant is water.

15. The method of claim 13 wherein said heated fluid is steam.

16. The method of claim 13 wherein said coolant is circulated about an upper portion of the casing an axial distance downward of at least 75 feet.

17. The method of claim 13 wherein said oil has an API gravity of less that 15°.

18. A method of recovering oil from a heavy oil-containing, outcropping formation, said heavy oil having an API gravity of less than 10°, comprising:

introducing a casing into said formation a distance of at least about 1000 feet, said casing comprising an upper portion terminating at its upper end adjacent a well head said formation and a lower portion having a plurality of apertures for the passage therethrough of oil;

heating the casing and adjacent formation to a temperature at which oil having an API gravity of less than 10° flows into said cavity by circulating a heated fluid substantially throughout the length of said casing and in indirect heat exchange with the casing;

circulating a coolant in indirect heat exchange about the upper portion of the casing, said coolant being circulated at a rate sufficient to prevent transfer of heat from the upper portion of the casing to the adjacent formation; and recovering oil having an API gravity of less than 10° from said casing.

19. The method of claim 17 wherein said coolant is water.

20. The method of claim 19 wherein said heated fluid is steam.

21. The method of claim 20 wherein said coolant is circulated about an upper portion of said conduit an axial distance downward of at least 75 feet.

22. The method of claim 21 wherein said oil is filtered prior to entering said casing.

* * * * *